US005204059A

United States Patent [19]

Sahira et al.

[11] Patent Number: 5,204,059

[45] Date of Patent: Apr. 20, 1993

[54] NI BASE ALLOY FOR SPARK PLUG ELECTRODES OF INTERNAL COMBUSTION ENGINES

[75] Inventors: Kensho Sahira, Yono; Hideo Kitamura, Omiya; Akira Mimura, Konosu; Nobuyoshi Kurauchi, Kitamoto, all of Japan

[73] Assignee: Mitsubishi Metal Corporation, Tokyo, Japan

[21] Appl. No.: 804,486

[22] Filed: Dec. 9, 1991

Related U.S. Application Data

[63] Continuation of Ser. No. 464,573, Jan. 16, 1990, abandoned, which is a continuation of Ser. No. 346,989, May 3, 1989, abandoned.

[30] Foreign Application Priority Data

Jul. 25, 1988 [JP] Japan ..... 63-185291
Jul. 25, 1988 [JP] Japan ..... 63-185292
Jul. 25, 1988 [JP] Japan ..... 63-185293

[51] Int. Cl.[5] ..... C22C 19/03; C22C 19/05

[52] U.S. Cl. ..... 420/445; 420/459; 123/169 EL

[58] Field of Search ..... 420/443, 445, 455, 459; 123/169 EL; 148/428, 429

[56] References Cited

U.S. PATENT DOCUMENTS 3,810,754 5/1974 Ford et al. ..... 420/445
3,832,167 8/1974 Shaw et al. ..... 420/455
4,329,174 5/1982 Ito et al. ..... 420/455

FOREIGN PATENT DOCUMENTS 770490 3/1957 United Kingdom .
2031950 4/1980 United Kingdom .
2211515 7/1989 United Kingdom .

*Primary Examiner*—R. Dean
*Assistant Examiner*—Margery S. Phipps
*Attorney, Agent, or Firm*—Frishauf, Holtz, Goodman & Woodward

[57] ABSTRACT

An Ni base alloy for use in spark plug electrodes for internal combustion engines which consists essentially of, on a weight percent basis,
0.1 to 1.5% Si,
0.1 to 0.65% Mn,
3.1 to 5% Al,
0 to 2% Cr,
0 to 0.5% of one or more elements selected from the group consisting of Y and rare earth elements,
0 to 5% Co,
0 to 0.5% of Hf and/or Re, and
the remainder Ni and incidental impurities.

2 Claims, No Drawings

NI BASE ALLOY FOR SPARK PLUG ELECTRODES OF INTERNAL COMBUSTION ENGINES

This application is a continuation of application Ser. No. 07/464,573, filed Jan. 16, 1990, abandoned; which is a continuation of U.S. Ser. No. 07/346,989 filed May 3, 1989 (abandoned).

FIELD OF THE INVENTION

The present invention relates to an Ni base alloy having especially high strength at elevated temperatures, as well as excellent melting loss resistance, corrosion resistance at elevated temperatures and spark consumption resistance as required for use in spark plug electrodes for internal combustion engines.

BACKGROUND OF THE INVENTION

Materials for making spark plug electrodes for internal combustion engines, for example, automotive engines. are required to have high strength at elevated temperatures, high melting loss resistance, high corrosion resistance at elevated temperatures, and high spark consumption resistance.

An Ni alloy having these properties as described in, for example, Japanese Patent Publication No. 43897/85 (corresponding to U.S. Pat. No. 4,329,174) has conventionally been used in spark plug electrodes and consists essentially of, on a weight percent basis, 0.2 to 3% Si, less than 0.5% Mn, at least two elements selected from the group consisting of 0.2 to 3% Cr, 0.2 to 3% Al and 0.01 to 1% Y, and the balance Ni and incidental impurities.

On the other hand, since the temperature of the combustion chamber atmosphere is greatly elevated in recently developed engines due to their high rotational speeds and the use of high octane value petroleum, the spark plug electrodes are exposed to very high temperature combustion atmospheres.

Although the conventional Ni base alloy described above exhibits good melting loss resistance, corrosion resistance at elevated temperatures and spark consumption loss in high temperature combustion atmospheres, its strength at elevated temperatures is not adequate. Accordingly, spark plug electrodes made of such a conventional Ni alloy cannot withstand practical use for long periods of time under such harsh operating conditions and the life of conventional electrodes is naturally rather short.

SUMMARY OF THE INVENTION

The present invention relates to a novel Ni base alloy for spark plug electrodes of internal combustion engines that displays improved strength at elevated temperatures and consists essentially of, on a weight percent basis, 0.1 to 1.5% Si, 0.1 to 0.65% Mn, 3.1 to 5% Al, 0 to 2% Cr, 0 to 0.5% of one or more elements selected from the group consisting of Y and rare earth elements, 0 to 5% Co and 0 to 0.5% of Hf and/or Re, and the remainder Ni and incidental impurities.

DETAILED DESCRIPTION OF THE INVENTION

In view of the above-mentioned circumstances, the inventors have conducted various studies with a view to providing a material not only having the ordinary properties required of spark plug electrodes but also displaying improved strength at elevated temperatures, and have found that an Ni base alloy containing 0.1 to 1.5% Si, 0.1 to 0.65% Mn and 3.1 to 5% Al and the remainder Ni and incidental impurities exhibits especially high strength at elevated temperatures, as well as displaying favorable melting loss resistance, corrosion resistance at elevated temperatures and spark consumption resistance. Accordingly, when used in spark plug electrodes for internal combustion engines, this alloy exhibits excellent properties for long periods of time even in a combustion gas atmosphere at elevated temperatures.

Additionally, the inventors have made the following findings. If Cr is incorporated in the Ni base alloy in an amount of less than 2%, the resultant Ni alloy will exhibit even better corrosion resistance. If one or more elements selected from the group consisting of Y and rare earth elements are incorporated in the Ni alloy in a total amount of less than 0.5%, the resultant Ni alloy enjoys even better melting loss resistance and corrosion resistance at elevated temperatures. If Co is incorporated in the Ni base alloy in an amount of less than 5%, the resultant Ni alloy exhibits even better strength at elevated temperatures. If Re and/or Hf are incorporated in the Ni base alloy in an amount of less than 0.5%, the resultant Ni alloy also exhibits even higher strength at elevated temperatures.

This invention has been accomplished on the basis of these findings and relates to a novel Ni base alloy having in particular excellent strength at elevated temperatures such as to make it suitable for use in spark plug electrodes for internal combustion engines and which consists essentially of, on a weight percent basis, 0.1 to 1.5% Si, 0.1 to 0.65% Mn, 3.1 to 5% Al, optionally, 0 to 2% Cr, 0 to 0.5% of at least one element selected from the group consisting of Y and rare earth elements, 0 to 5% Co and 0 to 0.5% of Hf and/or Re, and the remainder Ni and incidental impurities.

The above-mentioned alloying elements are contained in the following ranges for the technical reasons described below.

(a) Si

The Si incorporated in the Ni alloy greatly improves the high temperature corrosion resistance and spark consumption resistance, without decreasing the melting loss resistance. If the Si content is less than 0.1%, the desired improvement in these properties cannot be obtained. On the other hand, if the Si content exceeds 1.5%, the melting loss resistance of the Ni base alloy tends to decrease. Consequently, the Si content is determined to fall in the range of 0.1 to 1.5%.

(b) Mn

The Mn is an indispensable component which exhibits a deoxidizing and desulfurizing effect when added to the molten Ni base alloy. If the Mn content is less than 0.1%, the desired deoxidizing and desulfurizing effect cannot be obtained, while on the other hand, if the Mn content is more than 0.65%, the corrosion resistance at elevated temperatures is sharply reduced. Thus, the Mn content is defined to fall in the range of 0.1 to 0.65%.

(c) Al

The Al incorporated in the Ni base alloy remarkably heightens the strength and corrosion resistance at elevated temperatures. If the amount of Al is less than 3.1%, the desired level of said properties cannot be attained. On the other hand, if the amount of Al is more than 5%, the workability of the resultant Ni base alloy will deteriorate. Thus the Al content is defined to fall in the range of 3.1 to 5%.

(d) Cr

The Cr is optionally added to the Ni base alloy as it remarkably improves the corrosion resistance at elevated temperatures. If the amount of Cr is less than 0.1%, the desired level of corrosion resistance at elevated temperatures cannot be obtained. On the other hand, if the amount of Cr exceeds 2%, the melting loss resistance of the resultant Ni base alloy tends to decrease. The favorable range of the Cr content is therefore defined as being between 0.1% and 2%.

(e) Y and rare earth elements

These elements are optionally added to the Ni base alloy as they improve both the melting loss resistance and the corrosion resistance at elevated temperatures. If the amount of one or more of these elements is less than 0.001%, the resultant alloy cannot exhibit the required properties to the desired extent. On the other hand, if the amount of one or more of these elements exceeds 0.5%, no further improvement in the properties can be obtained. The amounts of Y and rare earth elements are hence defined as being in the range of 0.001 to 0.5%, taking into consideration the need for economy.

(f) Co

The Co incorporated in the Ni base alloy improves the strength at elevated temperatures to a much greater extent than that obtained by the coexisting Al. If the amount of Co is less than 0.5%, the resultant alloy will not exhibit the required high temperature strength to the desired extent. On the other hand, if the amount of Co exceeds 5%, no further improvement in the high temperature strength can be obtained. The amount of Co is therefore defined as falling in the range of 0.5 to 5%.

(g) Hf and Re

These elements greatly improve the high temperature strength of the Ni base alloy. If the amount of each or both of these elements is less than 0.001%, the resultant alloy will not exhibit the required high temperature strength to the desired high level. On the other hand, if the amount of Hf and/or Re is more than 0.5%, the workability of the resultant alloy tends to become lower. The total amounts of Hf and/or Re are therefore defined to fall within the range of 0.001 to 0.5%.

Some examples of Ni base alloy produced in accordance with the present invention will next be explained in detail.

EXAMPLE 1

A series of Ni base alloys according to this invention, specimen Nos. 1 to 18, another series of comparative Ni base alloys, specimen Nos. 1 to 4, and still another series of conventional Ni base alloys, specimen Nos. 1 to 4, were melted in an ordinary vacuum melting furnace, and then cast into ingots in a vacuum. The composition of each of these alloys is shown in Table 1.

Each of the resultant ingots was hot forged into a round bar having a diameter of 10 mm, and further cut, drawn, or forged into various shapes (a) to (d) as below.

(a) specimens for evaluating high temperature tensile strength, each having a 6 mm×2 mm cross section; and specimens for high temperature fatigue test according to JIS Z 2275, each having a size of 6 mm thickness (t)×30 mm R×25 mm grip breadth (b), (b) high temperature corrosion resistance test specimens, each having a size of 5 mm diameter×50 mm length, (c) wire specimens for the center electrodes of spark plugs and for evaluating spark consumption resistance, each having 2.5 mm diameter, and earth electrode wire specimens, each having a 2.5 mm×1.4 mm cross section, (d) specimens for measuring the temperature at which melt-down starts and for evaluating melting loss resistance, each having a 2.5 mm×1.4 mm cross section.

These test specimens were subjected to various tests as follows.

A high temperature tensile test was carried out at 800° C. to measure the tensile strength.

A high temperature fatigue test was carried out at a temperature 800° C. under a bending stress of 5 Kgf/mm$^2$ and with a cyclic load application speed of 2000 times/min., and number of cycles to rupture was measured in each case.

A high temperature corrosion resistanced test was carried out as follows: Each of the test specimens was put on an alumina boat which was placed in an apparatus filled with combustion gas. Any Pb compound capable of forming PbO as a combustion product was continuously supplied into the combustion gas atmosphere at a constant feeding rate. Each of the test specimens was heated and kept at 800° C. for 50 hours in the apparatus. After that, the scale formed on the test specimen was rubbed off with a wire brush. The descaled test specimen that had been subjected to the corrosion test was compared in weight terms with the test specimen not subjected to the corrosion test to allow the weight loss to be estimated.

A spark consumption test was carried out as follows. Both a center electrode and an earth electrode were fitted to a spark plug with an initial gap (distance between two electrodes) of 0.8 mm. This spark plug was then incorporated in a 2000 cc gasoline engine equipped with a turbo charger. The gasoline engine was driven in motion at a rotational speed of 5500 r.p.m. for 100 hours. The increase in size of the gap was then measured.

In a test for evaluating melting loss, the temperature at which melt-down commenced was measured.

All these test results are shown in Table 1.

TABLE 1

| | composition (weight %) | | | | | | | high temperature strength | | high temp. corrosion resistance | spark consumption resistance | melting loss property melt-down |
|---|---|---|---|---|---|---|---|---|---|---|---|---|
| | Si | Mn | Al | Cr | Y | rare earth element | Ni + impurities | tensile strength at 800° C. (kg/mm$^2$) | number of cycles to rupture at 800° C. (numbers) | weight loss (mg/cm$^2$) | amount of gap increase (mm) | starting temp. (°C.) |
| Ni base alloy of this invention | | | | | | | | | | | | |
| 1 | 0.12 | 0.48 | 4.05 | — | — | — | bal. | 13.9 | 2.19 × 10$^6$ | 3.24 | 0.16 | 1390 |
| 2 | 0.81 | 0.54 | 3.97 | — | — | — | " | 13.8 | 2.22 × 10$^6$ | 3.40 | 0.12 | 1382 |

TABLE 1-continued

| | | | | | | | | | | | | |
|---|---|---|---|---|---|---|---|---|---|---|---|---|
| 3 | 1.47 | 0.51 | 4.11 | — | — | — | " | 14.4 | $2.32 \times 10^6$ | 2.98 | 0.12 | 1370 |
| 4 | 0.75 | 0.11 | 4.15 | — | — | — | " | 14.6 | $2.68 \times 10^6$ | 3.18 | 0.14 | 1377 |
| 5 | 0.72 | 0.64 | 3.99 | — | — | — | " | 14.0 | $2.11 \times 10^6$ | 3.33 | 0.15 | 1378 |
| 6 | 0.84 | 0.38 | 3.13 | — | — | — | " | 13.5 | $2.00 \times 10^6$ | 3.42 | 0.18 | 1378 |
| 7 | 0.80 | 0.41 | 4.94 | — | — | — | " | 14.9 | $2.97 \times 10^6$ | 2.81 | 0.16 | 1372 |
| 8 | 0.92 | 0.57 | 3.27 | 0.11 | — | — | " | 14.1 | $2.19 \times 10^6$ | 2.71 | 0.13 | 1374 |
| 9 | 0.89 | 0.59 | 3.21 | 1.04 | — | — | " | 14.3 | $2.24 \times 10^6$ | 2.28 | 0.17 | 1376 |
| 10 | 0.94 | 0.49 | 3.16 | 1.98 | — | — | " | 14.8 | $2.82 \times 10^6$ | 2.06 | 0.14 | 1374 |
| 11 | 0.31 | 0.19 | 4.21 | — | 0.131 | — | " | 14.7 | $2.69 \times 10^6$ | 2.72 | 0.14 | 1379 |
| 12 | 0.77 | 0.31 | 4.04 | — | 0.490 | — | " | 14.7 | $2.73 \times 10^6$ | 2.65 | 0.17 | 1375 |
| 13 | 0.91 | 0.37 | 3.87 | — | — | Ce: 0.0014 | " | 14.1 | $2.13 \times 10^6$ | 2.84 | 0.15 | 1377 |
| 14 | 1.23 | 0.55 | 3.87 | — | — | Ce: 0.052<br>Nd: 0.019<br>La: 0.026 | " | 13.9 | $2.10 \times 10^6$ | 2.74 | 0.16 | 1376 |
| 15 | 1.07 | 0.48 | 4.01 | — | 0.054 | La: 0.032 | " | 14.5 | $2.66 \times 10^6$ | 2.73 | 0.14 | 1374 |
| 16 | 0.81 | 0.60 | 3.54 | 0.32 | 0.0014 | — | " | 14.7 | $2.67 \times 10^6$ | 2.08 | 0.11 | 1380 |
| 17 | 1.32 | 0.21 | 3.18 | 0.68 | — | Ce: 0.113<br>La: 0.124 | " | 14.0 | $2.11 \times 10^6$ | 1.95 | 0.10 | 1375 |
| 18 | 0.77 | 0.12 | 3.26 | 1.40 | 0.213 | Ce: 0.420 | " | 14.9 | $2.87 \times 10^6$ | 1.86 | 0.13 | 1388 |
| Comparative Ni base alloy | | | | | | | | | | | | |
| 1 | —* | 0.53 | 3.30 | — | — | — | " | 13.2 | $2.01 \times 10^6$ | 8.42 | 0.31 | 1382 |
| 2 | 1.74* | 0.33 | 4.21 | — | — | — | " | 14.1 | $2.11 \times 10^6$ | 3.41 | 0.19 | 1336 |
| 3 | 0.79 | 0.89* | 4.11 | — | — | — | " | 13.8 | $2.02 \times 10^6$ | 9.13 | 0.14 | 1384 |
| 4 | 1.31 | 0.49 | 2.90* | — | — | — | " | 11.8 | $1.41 \times 10^6$ | 3.24 | 0.11 | 1371 |
| Conventional Ni base alloy | | | | | | | | | | | | |
| 1 | 1.13 | 0.31 | 1.54 | 0.52 | — | — | " | 10.4 | $1.12 \times 10^6$ | 3.04 | 0.14 | 1376 |
| 2 | 0.34 | 0.24 | — | 1.32 | 0.09 | — | " | 9.7 | $1.01 \times 10^6$ | 3.52 | 0.17 | 1387 |
| 3 | 2.40 | 0.16 | 2.93 | — | 0.64 | — | " | 10.9 | $1.14 \times 10^6$ | 3.01 | 0.12 | 1370 |
| 4 | 1.71 | 0.42 | 2.41 | 1.96 | 0.03 | — | " | 11.3 | $1.32 \times 10^6$ | 2.07 | 0.13 | 1374 |

*outside the scope of this invention

It will be apparent from the test results shown in Table 1 that all the test specimens Nos. 1 to 18 of the Ni base alloy according to this invention exhibit high temperature corrosion resistance, spark consumption resistance and melting loss resistance equally as good as the comparative test specimens Nos. 1 to 4 and even better high temperature strength than that of the comparative test specimens. On the other hand, the comparative test specimens Nos. 1 to 4, which are outside the scope of this invention in terms of the content of at least one of the elements (marked * in Table 1), are seen to be inferior to the test specimens of this invention with respect to at least one of these three properties.

As explained in detail above, since the Ni base alloys of this invention are particularly excellent in high temperature strength as well as having good properties in terms of high temperature corrosion resistance, spark consumption resistance and melting loss resistance, the high performance of spark plug electrodes for internal combustion engines formed from the Ni base alloys of this invention can be maintained for very long periods of time even if exposed to harsh operating conditions.

EXAMPLE 2

A series of Ni base alloys according to this invention, specimen Nos. 1 to 12, another series of comparative Ni base alloys, specimen Nos. 1 to 5, and still another series of conventional Ni base alloys, specimen Nos. 1 to 4, were melted in an ordinary vacuum melting furnace, and then cast into ingots in a vacuum. The composition of each of these alloys is shown in Table 2.

Each of the resultant ingots was hot forged into a round bar having a diameter of 10 mm, and further cut, drawn, or forged into various shapes (a) to (d) as below.

(a) specimens for evaluating high temperature tensile strength, each having a 6 mm×2 mm cross section; and specimens for a high temperature fatigue test according to JIS Z 2275, each having a size of 6 mm thickness (t)×30 mm R×25 mm grip breadth (b), (b) high temperature corrosion resistance test specimens, each having a size of 5 mm diameter×50 mm length, (c) wire specimens for the center electrodes of spark plugs and for evaluating spark consumption resistance, each having a diameter of 2.5 mm, and earth electrode wire specimens, each having a cross section of 2.5 mm×1.4 mm, (d) specimens for measuring the temperature at which melt-down starts and for evaluating melting loss resistance, each having a cross section of 2.5 mm×1.4 mm.

These test specimens were subjected to various tests as follows.

The high temperature tensile test was carried out at 700° C. to measure the tensile strength.

The high temperature fatigue test was carried out at a temperature of 700° C. under a bending stress of 6 $Kgf/mm^2$ and with a cyclic load application speed of 3000 times/min., and number of cycles to rupture was measured in each case.

The high temperature corrosion resistance test was carried out as follows: Each of the test specimens was put on an alumina boat which was itself placed in an apparatus filled with combustion gas. A Pb compound capable of forming PbO as a combustion product was continuously supplied to the combustion gas atmosphere at a constant feeding rate. Each of the test specimens was heated and kept in the apparatus at 700° C. for 100 hours. After that, the scale formed on the test specimen was rubbed off with a wire brush. The descaled test specimen that had been subjected to the corrosion test was compared in weight with the test specimen that had not been subjected to the corrosion test to estimate the weight loss.

The spark consumption test was carried out as follows. Both a center electrode and an earth electrode were fitted to a spark plug with an initial gap (distance between two electrodes) of 0.8 mm. This spark plug was then incorporated in a 1800 cc gasoline engine equipped with a turbo charger. The gasoline engine was driven in motion at a rotational speed of 5500 r.p.m. for 100 hours. Any increase in size of the gap was then measured.

In the test for evaluating melting loss, the temperature at which melt-down started was measured.

All these test results are shown in Table 2.

TABLE 2

| | composition (weight %) | | | | | | | | high temperature strength | | high temp. | spark consumption | melting loss property |
|---|---|---|---|---|---|---|---|---|---|---|---|---|---|
| | Si | Mn | Al | Co | Cr | Y | rare earth element | Ni + impurities | tensile strength at 700° C. (kg/mm²) | number of cycles to rupture at 700° C. (numbers) | corrosion resistance weight loss (mg/cm²) | resistance amount of gap increase (mm) | melt-down starting temp. (°C.) |
| Ni base alloy of this invention | | | | | | | | | | | | | |
| 1 | 0.13 | 0.56 | 3.95 | 1.31 | — | — | — | bal. | 22.3 | $1.38 \times 10^7$ | 1.89 | 0.19 | 1386 |
| 2 | 0.78 | 0.49 | 4.11 | 1.57 | — | — | — | — | 23.1 | $1.66 \times 10^7$ | 1.73 | 0.18 | 1374 |
| 3 | 1.49 | 0.62 | 4.03 | 1.24 | — | — | — | — | 22.9 | $1.47 \times 10^7$ | 1.77 | 0.17 | 1370 |
| 4 | 0.81 | 0.11 | 3.84 | 2.34 | — | — | — | — | 23.5 | $1.57 \times 10^7$ | 1.94 | 0.16 | 1378 |
| 5 | 1.25 | 0.28 | 4.96 | 0.92 | — | — | — | — | 21.2 | $1.04 \times 10^7$ | 1.68 | 0.19 | 1376 |
| 6 | 0.72 | 0.44 | 3.87 | 0.53 | — | — | — | — | 20.9 | $1.10 \times 10^7$ | 1.79 | 0.18 | 1384 |
| 7 | 0.81 | 0.39 | 4.10 | 4.93 | — | — | — | — | 25.8 | $1.97 \times 10^7$ | 1.84 | 0.18 | 1381 |
| 8 | 0.88 | 0.24 | 3.23 | 3.01 | 1.58 | 0.0013 | — | — | 23.5 | $1.60 \times 10^7$ | 1.18 | 0.17 | 1379 |
| 9 | 1.24 | 0.44 | 3.92 | 1.95 | 0.80 | 0.364 | — | — | 22.7 | $1.40 \times 10^7$ | 1.06 | 0.16 | 1371 |
| 10 | 0.73 | 0.47 | 4.00 | 2.01 | 0.54 | 0.423 | — | — | 22.9 | $1.35 \times 10^7$ | 1.19 | 0.16 | 1375 |
| 11 | 0.77 | 0.28 | 3.79 | 1.96 | 1.54 | — | Ce: 0.048<br>Nd: 0.015<br>La: 0.021 | — | 21.8 | $1.04 \times 10^7$ | 1.17 | 0.17 | 1377 |
| 12 | 1.01 | 0.33 | 3.18 | 2.59 | 1.24 | 0.036 | La: 0.024 | — | 22.9 | $1.48 \times 10^7$ | 1.09 | 0.16 | 1376 |
| Comparative Ni base alloy | | | | | | | | | | | | | |
| 1 | —* | 0.89* | 3.54 | 4.30 | — | — | — | — | 24.2 | $1.85 \times 10^7$ | 4.26 | 0.36 | 1382 |
| 2 | 1.70* | 0.60 | 2.94* | 2.55 | — | — | — | — | 23.5 | $1.82 \times 10^7$ | 1.84 | 0.17 | 1339 |
| 3 | 0.72 | 1.21* | 4.05 | 3.04 | — | — | — | — | 25.7 | $2.06 \times 10^7$ | 7.18 | 0.29 | 1374 |
| 4 | 0.58 | 0.22 | 1.86* | 1.02 | — | — | — | — | 18.8 | $7.01 \times 10^7$ | 3.45 | 0.20 | 1380 |
| 5 | 0.34 | 0.23 | 2.63* | 0.31* | — | — | — | — | 17.2 | $8.84 \times 10^6$ | 2.02 | 0.17 | 1379 |
| Conventional Ni base alloy | | | | | | | | | | | | | |
| 1 | 0.32 | 0.30 | 0.94 | — | 0.91 | — | — | — | 16.2 | $8.13 \times 10^6$ | 1.88 | 0.19 | 1388 |
| 2 | 2.41 | 0.21 | — | — | 0.54 | 0.04 | — | — | 14.6 | $5.01 \times 10^6$ | 1.48 | 0.17 | 1368 |
| 3 | 1.65 | 0.22 | 2.54 | — | — | 0.32 | — | — | 17.2 | $8.43 \times 10^6$ | 1.42 | 0.17 | 1370 |
| 4 | 0.64 | 0.26 | 1.56 | — | 2.65 | 0.77 | — | — | 16.6 | $8.02 \times 10^6$ | 1.08 | 0.18 | 1377 |

*outside the scope of this invention

It will be apparent from the test results shown in Table 2 that all the test specimens Nos. 1 to 12 of the Ni base alloy according to this invention exhibit high temperature corrosion resistance, spark consumption resistance and melting loss resistance equally as well as the comparative test specimens Nos. 1 to 4 and also exhibit even better high temperature strength than that of the comparative test specimens. On the other hand, the comparative test specimens Nos. 1 to 5, which are outside the scope of this invention in terms of the content of at least one of the elements (marked * in Table 2), are inferior to the test specimens of this invention with respect to at least one of these three properties.

As explained in detail above, since the Ni base alloys of this invention have particularly remarkable values of high temperature strength as well as good high temperature corrosion resistance, spark consumption resistance and melting loss resistance, the high performance of spark plug electrodes for internal combustion engines formed from the Ni base alloys of this invention can be maintained for very long periods of time even if exposed to harsh operating conditions.

EXAMPLE 3

A series of Ni base alloys according to this invention, specimen Nos. 1 to 11, another series of comparative Ni base alloys, specimen Nos. 1 to 5, and still another series of conventional Ni base alloys, specimen Nos. 1 to 4, were melted in an ordinary vacuum melting furnace, and then cast into ingots in a vacuum. The composition of each of these alloys is shown in Table 3.

Each of the resultant ingots was hot forged into a round bar having a diameter of 10 mm, and further cut, drawn, or forged into various shapes (a) to (d) as below.

(a) specimens for evaluating high temperature tensile strength, each having a cross section of 6 mm×2 mm; and specimens for a high temperature fatigue test according to JIS Z 2275, each having a size of 6 mm thickness (t)×30 mm R×25 mm grip breadth (b), (b) high temperature corrosion resistance test specimens, each having a size of 5 mm diameter×50 mm length, (c) wire specimens for the center electrodes of spark plugs and for evaluating spark consumption resistance, each having a diameter of 2.5 mm, and earth electrode wire specimens, each having a cross section of 2.5 mm×1.4 mm, (d) specimens for measuring the temperature at which melt-down starts and for evaluating melting loss resistance, each having a cross section of 2.5 mm×1.4 mm.

These test specimens were subjected to various tests as follows.

The high temperature tensile test was carried out at 750° C. to measure the tensile strength.

The high temperature fatigue test was carried out at a temperature of 750° C. under a bending stress of 7 Kgf/mm² and with a cyclic load application speed of 2500 times/min., and number of cycles to rupture was measured in each case.

The high temperature corrosion resistance test was carried out as follows: Each of the test specimens was put on an alumina boat which was itself placed in an apparatus filled with combustion gas. A Pb compound capable of forming PbO as a combustion product was continuously supplied to the combustion gas atmosphere at a constant feeding rate. Each of the test specimens was heated and kept in the apparatus at 800° C. for 100 hours. After that, the scale formed on the test specimen was rubbed off with a wire brush. The descaled test specimen that had been subjected to the corrosion test was compared in weight with the test specimen that had not been subjected to the corrosion test to estimate the weight loss.

The spark consumption test was carried out as follows. Both the center electrode and the earth electrode were fitted to a spark plug with an initial gap (distance between two electrodes) of 0.8 mm. This spark plug was then incorporated in a 3000 cc gasoline engine equipped with a turbo charger. The gasoline engine was driven in motion at a rotational speed of 5000 r.p.m. for 100 hours. Any increase in the gap was then measured.

In the test for evaluating melting loss, the temperature at which melt-down started was measured.

All these test results are shown in Table 3.

TABLE 3

| | composition (weight %) | | | | | | | high temperature strength | | high temp. corrosion resistance | spark consumption resistance | melting loss property melt-down |
|---|---|---|---|---|---|---|---|---|---|---|---|---|
| | Si | Mn | Al | Hf | Re | Cr | Ni + impurities | tensile strength at 750° C. (kg/mm²) | number of cycles to rupture at 750° C. (numbers) | weight loss (mg/cm²) | amount of gap increase (mm) | starting temp. (°C.) |
| Ni base alloy of this invention | | | | | | | | | | | | |
| 1 | 0.13 | 0.48 | 3.54 | 0.021 | — | — | bal. | 17.8 | $6.22 \times 10^6$ | 4.67 | 0.11 | 1382 |
| 2 | 0.82 | 0.53 | 3.28 | 0.053 | — | — | " | 17.6 | $6.27 \times 10^6$ | 4.77 | 0.10 | 1373 |
| 3 | 1.48 | 0.45 | 3.33 | 0.074 | — | — | " | 17.7 | $6.48 \times 10^6$ | 4.56 | 0.10 | 1370 |
| 4 | 0.68 | 0.11 | 4.34 | — | 0.082 | — | " | 18.2 | $6.93 \times 10^6$ | 4.18 | 0.09 | 1375 |
| 5 | 0.72 | 0.38 | 4.96 | 0.038 | — | — | " | 18.6 | $7.00 \times 10^6$ | 4.06 | 0.08 | 1376 |
| 6 | 1.02 | 0.64 | 3.26 | 0.495 | — | — | " | 17.8 | $6.33 \times 10^6$ | 4.36 | 0.10 | 1377 |
| 7 | 0.46 | 0.22 | 4.15 | — | 0.012 | — | " | 18.1 | $6.72 \times 10^6$ | 4.11 | 0.09 | 1378 |
| 8 | 1.23 | 0.44 | 3.97 | — | 0.058 | — | " | 17.9 | $6.88 \times 10^6$ | 4.26 | 0.11 | 1370 |
| 9 | 0.72 | 0.48 | 3.25 | 0.0014 | 0.023 | — | " | 17.7 | $6.45 \times 10^6$ | 4.20 | 0.09 | 1381 |
| 10 | 0.92 | 0.38 | 3.75 | — | 0.31 | 0.12 | " | 17.6 | $6.77 \times 10^6$ | 4.36 | 0.11 | 1380 |
| 11 | 0.84 | 0.43 | 3.81 | 0.019 | — | 0.54 | " | 17.4 | $6.21 \times 10^6$ | 4.19 | 0.11 | 1377 |
| Comparative Ni base alloy | | | | | | | | | | | | |
| 1 | —* | 0.92* | 3.66 | — | 0.087 | — | " | 17.3 | $6.42 \times 10^6$ | 5.99 | 0.21 | 1382 |
| 2 | 1.67* | 0.78* | 2.88* | 0.077 | — | — | " | 17.2 | $6.68 \times 10^6$ | 4.18 | 0.12 | 1337 |
| 3 | 0.66 | 1.20* | 2.97* | — | 0.009 | — | " | 16.8 | $5.42 \times 10^6$ | 12.18 | 0.10 | 1374 |
| 4 | 0.72 | 0.36 | 1.72* | 0.12 | 0.022 | — | " | 14.3 | $4.86 \times 10^6$ | 4.94 | 0.11 | 1376 |
| 5 | 0.84 | 0.45 | 2.54* | —* | —* | — | " | 14.2 | $3.82 \times 10^6$ | 4.96 | 0.11 | 1379 |
| Conventional Ni base alloy | | | | | | | | | | | | |
| 1 | 0.36 | 0.24 | 1.54 | — | — | 0.87 | " | 13.4 | $3.46 \times 10^6$ | 5.01 | 0.11 | 1382 |
| 2 | 0.94 | 0.23 | — | Y: 0.03 | — | 2.19 | " | 11.9 | $3.10 \times 10^6$ | 4.50 | 0.11 | 1377 |
| 3 | 1.74 | 0.42 | 0.61 | Y: 0.24 | — | — | " | 12.8 | $3.06 \times 10^6$ | 4.06 | 0.10 | 1366 |
| 4 | 2.66 | 0.33 | 2.23 | Y: 0.65 | — | 1.04 | " | 14.8 | $3.63 \times 10^6$ | 3.98 | 0.08 | 1364 |

*outside the scope of this invention

It will be apparent from the test results shown in Table 3 that all the test specimens Nos. 1 to 11 of the Ni base alloy according to this invention exhibit high temperature corrosion resistance, spark consumption resistance and melting loss resistance equally as well as the comparative test specimens Nos. 1 to 4 and exhibit even better high temperature strength than that of the comparative test specimens. On the other hand, the comparative test specimens Nos. 1 to 5, which are outside the scope of this invention in terms of the content of at least one of the elements (marked * in Table 3), are inferior to the test specimens of this invention with respect to at least one of these three properties.

As explained in detail above, since the Ni base alloys of this invention are particularly superior in high temperature strength as well as having good high temperature corrosion resistance, spark consumption resistance and melting loss resistance, the high performance of spark plug electrodes for internal combustion engines formed from the Ni base alloys of this invention can be maintained for very long periods of time even if exposed to harsh operating conditions.

Although the present invention has been explained with reference to preferred examples, it will be clearly understood to those skilled in the art that the present invention is not restricted to such examples alone and that many variations and combinations can be made without departing from the spirit and scope of the present invention.

What is claimed is:

1. A Ni base alloy which is forged and drawn to form a spark plug wire electrode for an internal combustion engine, which consists essentially of, on weight percent basis, from 0.5 to 0.9% Si, from 0.45 to 0.65% Mn, from 3.9 to 4.3% Al, and the remainder Ni and incidental impurities.

2. A Ni base alloy which is forged and drawn to form a spark plug wire electrode for an internal combustion engine, which consists essentially of, on a weight percent basis, from 0.5 to 0.9% Si, from 0.45 to 0.65% Mn, from 3.1 to 3.9% Al, from 1.25–1.75% Cr and the remainder Ni and incidental impurities.

* * * * *